US007870977B2

(12) United States Patent
Pietrowski et al.

(10) Patent No.: US 7,870,977 B2
(45) Date of Patent: Jan. 18, 2011

(54) DISPENSER HAVING AN IMPROVED INLET VALVE

(75) Inventors: Daria Pietrowski, Huntington Beach, CA (US); Douglas B. Dobbs, Yorba Linda, CA (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 828 days.

(21) Appl. No.: 11/116,205

(22) Filed: Apr. 28, 2005

(65) Prior Publication Data

US 2006/0243750 A1 Nov. 2, 2006

(51) Int. Cl.
*B65D 88/54* (2006.01)

(52) U.S. Cl. ..... 222/321.4; 222/321.2; 222/321.7

(58) Field of Classification Search ..... 222/319, 222/321.2, 321.7, 321.4, 145.8
See application file for complete search history.

(56) References Cited

U.S. PATENT DOCUMENTS 1,892,649 A 12/1932 Buenger
2,354,255 A 7/1944 Gillum et al.
2,589,581 A 3/1952 Sokolik
3,498,315 A 3/1970 Graves et al.
3,741,243 A 6/1973 Deibler et al.
4,286,622 A 9/1981 Ninomiya et al.
4,365,648 A 12/1982 Grothe
4,371,098 A * 2/1983 Nozawa et al. ..... 222/321.4
4,705,195 A 11/1987 Heck
5,482,188 A * 1/1996 Lina ..... 222/321.2
5,850,948 A * 12/1998 Garcia et al. ..... 222/321.9
6,220,483 B1 * 4/2001 van der Heijden ..... 222/136
6,508,269 B2 1/2003 Szabo et al.
6,668,856 B2 12/2003 Warlick

FOREIGN PATENT DOCUMENTS

EP 0990595 4/2000

OTHER PUBLICATIONS

EP Search report, EP06113323, published Dec. 5, 2007.

* cited by examiner

*Primary Examiner*—Kevin P Shaver
*Assistant Examiner*—Melvin A Cartagena
(74) *Attorney, Agent, or Firm*—MWV Intellectual Property Group

(57) ABSTRACT

A dispenser for use with a liquid product including beads which are rupturable to release additives when rubbed between the hands of a user. The dispenser includes a discharge head reciprocable between pressure and return strokes, and a valve assembly for respectively allowing and preventing liquid product from being discharged during the pressure and return strokes. The valve assembly includes ribs for guiding movement of a check valve disposable in respective valve open and closed positions in which the check valve is disposed out of and in contact with a valve seat. The valve assembly includes primary fluid passages for permitting passage of the liquid and beads into a pump cylinder, and secondary fluid passages for permitting displacement of the beads during translation of the check valve between the valve open to the valve closed positions for thereby preventing accumulation of beads between the check valve and its valve seat.

18 Claims, 2 Drawing Sheets

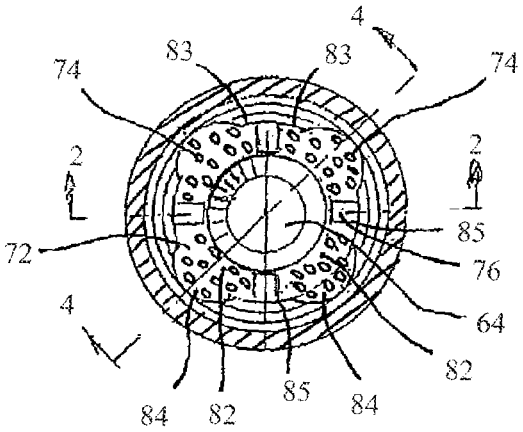
FIG. 2
FIG. 3
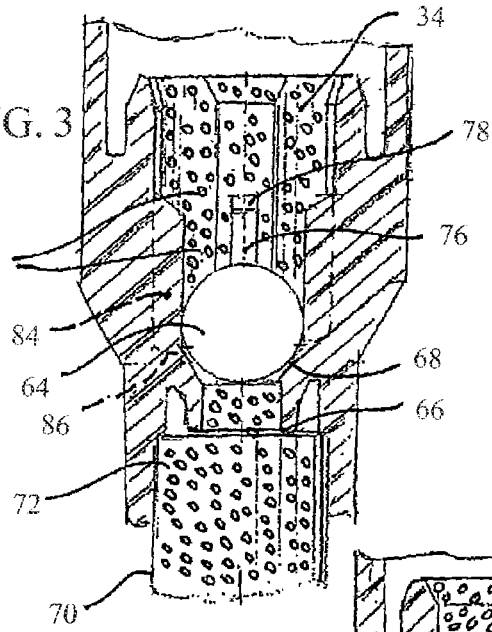
FIG. 4
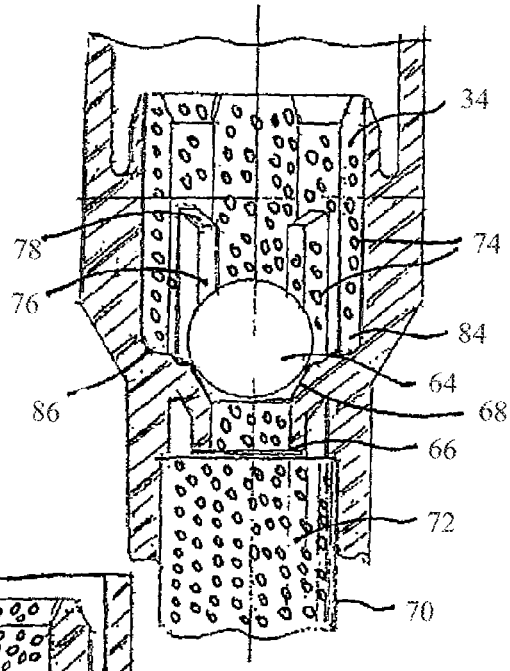
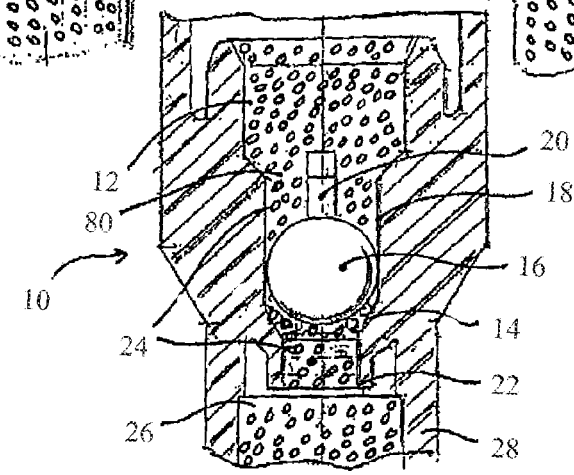
FIG. 5
RELATED ART

DISPENSER HAVING AN IMPROVED INLET VALVE

BACKGROUND OF INVENTION a. Field of Invention

The invention relates generally to improvements in pump dispensers, and more particularly to such pump dispensers having an improved inlet valve assembly for enabling a valve to properly seat against its valve seat for quick shut-off of the inlet port, especially when used with personal care products including "beads" containing fragrances, medicine, skin nutrients and other additives.

b. Description of Related Art

The known manually actuated pump dispensers especially those designed for the dispensing of personal care products which may be in the form of pastes, gels or other viscous products, typically have both inlet and outlet check valves for respectively controlling the flow of liquid product into the pump chamber during each piston suction (i.e. return) stroke and for controlling the outflow of the liquid product from the pump chamber during each piston compression (i.e. pressure) stroke. Such pump dispensers are advantageous in that they permit dispensing of products in a metered quantity over an extended period of use.

While such pump dispensers may operate adequately with typical viscous products having a uniform consistency, for a new type of personal care product which includes "beads" containing fragrances, medicine, skin nutrients and other additives, conventional pump dispensers have several drawbacks. Optimally, a pump dispenser for dispensing a personal care product containing beads would discharge a metered dose of the product, whereby a user can rub the product between his/her hands to thus frictionally break the beads and release the additives therein. The discharging of a metered dose of liquid product is essential, because the beads, which are of a predetermined size and contain a measured quantity of fragrances, medicine, skin nutrients and other additives, are intended to be discharged with a predetermined amount of liquid product to produce a desired end result. For example, in order to produce the desired degree of anti-bacterial cleansing, a 0.1 ounce metered dose of product may be required to include a minimal 5-to-1 liquid product-to-bead ratio. Thus, for the example provided above, a pump dispenser would be required to discharge a 0.1 ounce metered dose of product, and would further be required to ensure a minimal 5-to-1 liquid product-to-bead ratio. Any significant variation from the noted exemplary amounts would compromise the degree of anti-bacterial cleansing and render the pump dispenser inadequate for the intended purpose.

As a further example, referring to FIG. 5 of the present application, a related pump dispenser 10 is illustrated and includes an accumulator (i.e. pump cylinder) 12 having a valve seat 14 designed to retain ball check valve 16. During the discharge head pressure stroke, valve area 18 including guide ribs 20 is designed to guide ball check valve 16 into engagement with valve seat 14 to close inlet port 22. Further, during the discharge head return (i.e. suction) stroke, guide ribs 20 are designed to guide ball check valve 16 out of engagement with valve seat 14 to allow liquid product to by-pass ball check valve 16 between adjacently disposed ribs 20 and be dispensed out through an outlet port (not shown).

In use however, during successive pressure and return strokes, the relatively supple beads 24 disposed in the midst of liquid product 26 tend to accumulate below ball check valve 16 as illustrated in FIG. 5, and thereby interfere with valve 16 from properly seating against its seat 14. Thus after sufficient accumulation, the ensuing pressure stroke results in liquid product 26 collected in accumulator 12 returning to the container (not shown) via dip tube 28. As is well realized in the industry, such product return must be avoided to prevent contamination of unused product disposed in the container. Further, since the internal volume of accumulator 12 is designed to provide a metered dose of liquid product, any return of product to the container results in a less-than metered dose, which is undesirable. Yet further, as discussed above, since the discharged product is required to have a predetermined liquid product-to-bead ratio, accumulation of beads 24 below ball check valve 16 can increase or decrease the required liquid product-to-bead ratio, thus resulting in an unintended dosage of fragrances, medicine, skin nutrients or other additives in ratio to the liquid product.

Referring now to the related-art pump dispensers of U.S. Pat. No. 1,892,649 ('649 Patent), U.S. Pat. No. 2,589,581 ('581 Patent), U.S. Pat. No. 2,354,255 ('255 Patent), U.S. Pat. No. 3,498,315 ('315 Patent), U.S. Pat. No. 3,741,243 ('243 Patent), U.S. Pat. No. 4,705,195 ('195), U.S. Pat. No. 5,850,948 ('948), U.S. Pat. No. 6,508,269 ('269) and U.S. Pat. No. 6,668,856 ('856), while the pump dispensers and ball valves of the noted U.S. Patents are well known in the industry, none of the aforementioned U.S. Patents is known as being directed to addressing the aforementioned exemplary problems associated with personal care products including beads such as 24.

For example, as illustrated in FIG. 1 of the '649 Patent, a ball check valve 4 is provided and includes guide ribs 5-5 for guiding the valve to its seat 6 (Page 1:22-25). A removable plug 7 is provided for limiting upward travel of ball check valve 4, and for further enabling cleaning and/or replacement of valve 4 and valve seat 6, (Page 1:38-43). In this manner, the '649 Patent achieves the object of readily disassembling the valve parts for repair without dismounting the associated pipe connection, (Page 1:8-11). Thus, while the '649 Patent provides a removable plug 7 for accessing and cleaning ball check valve 4 and valve seat 6, and further provides guide ribs 5 for guiding movement of valve 4, the check valve assembly of the '649 Patent fails to recognize, much less solve, the aforementioned exemplary problems associated with personal care products including beads such as 24.

Similarly, as illustrated in FIG. 1 of the '255 Patent, a ball check valve 7 is provided and includes guide ribs 8 for guiding the valve to its seat 4 (Col. 1:42-46-Col. 2:9-11). Ribs 8 are provided for guiding valve 7 between its open and closed positions, and further permit free flow of fluid, (Col. 2:11-15). Ribs 8 include a rounded lip 9 against which ball check valve 7 rests in its open position, thus preventing valve 7 from sticking in its open position, (Col. 2:15-21). Thus, while the '255 Patent achieves its object of using the ribs to permit free passage of fluid and preventing ball check valve 7 from locking in its open position, as discussed above for the '649 Patent, the check valve assembly of the '255 Patent likewise fails to recognize or solve the aforementioned exemplary problems associated with personal care products including beads such as 24.

Turning to the '243 Patent, the check valve illustrated in FIG. 1 includes ball check valve 30 movably disposed in cylindrical portion 26, (Col. 1:58-59). For flow of liquid in the direction of arrow 36, ball check valve 30 is disposed in the FIG. 1 configuration and liquid flows through valve 10 as illustrated, (Col. 2:1-4). This flow path provides a large cross-sectional flow path to prevent solid particles from becoming trapped in the valve assembly, and obstructing the flow path, (Col. 1:5-13). Thus while the '243 Patent achieves its object of unrestricted flow for liquid containing solid particles by providing an enlarged flow path, as discussed above for the '649 and '255 Patents, the check valve assembly of the '243 Patent likewise fails to recognize or solve the noted exemplary problems associated with personal care products including beads such as 24.

The remaining '581, '315, '195, '948, '269 and '856 Patents, which provide exemplary features such as adequate ball valve guidance, nevertheless fail to solve, much less recognize, the drawbacks of conventional check valves when used with personal care products including beads such as 24.

It would therefore be of benefit to provide a pump dispenser having an improved inlet valve assembly for enabling a valve to properly seat against its valve seat for quick shut-off of the inlet port, especially when used with personal care products including beads containing fragrances, medicine, skin nutrients and other additives. It would also be of benefit to provide a valve assembly which facilitates simple and economical manufacture and assembly of the pump dispenser, which is reliable in operation to provide a desired liquid product-to-bead ratio while enabling dispensing of a metered dose of liquid product, and which minimizes the possibility of liquid product from being returned back to a supply container from within the dispenser accumulator.

SUMMARY OF INVENTION

The invention solves the problems and overcomes the drawbacks and deficiencies of prior art pump dispenser designs by providing an improved inlet valve assembly which enables a valve to properly seat against its valve seat and thus achieve quick shut-off of the inlet port.

The invention, which is especially directed for use with personal care products including beads containing fragrances, medicine, skin nutrients and other additives, achieves the aforementioned exemplary objects by providing a manual pump dispenser for use with a liquid product including a plurality of rupturable beads containing additives capable of being released when the beads are rubbed between the hands of a user. The pump dispenser may include a spring biased discharge head reciprocable between pressure and return strokes. A piston rod may be coupled to the discharge head and include a pump piston disposed adjacent one end thereof. The piston rod may be reciprocable with the discharge head to reciprocate the pump piston between the pressure and return strokes within a pump cylinder. A valve assembly may be provided in the pump cylinder to respectively allow and prevent the liquid product from being discharged through a discharge orifice in the discharge head during the pressure and return strokes. The valve assembly may include one or more longitudinally extending guide ribs for guiding axial and radial movement of a check valve. The check valve may be disposable in valve open and valve closed positions in which the check valve is respectively disposed out of and in contact with a valve seat. The valve assembly may include a longitudinally extending primary fluid passage disposed adjacent the guide rib for permitting passage of the liquid containing the beads from a container into the pump cylinder. The valve assembly may further include a longitudinally extending secondary fluid passage disposed adjacent the primary fluid passage for permitting displacement of the beads during translation of the check valve between the valve open to the valve closed positions for thereby preventing accumulation of the beads between the check valve and the valve seat.

For the pump dispenser described above, the piston rod may be axially movable relative to the pump piston and may include a lower surface engageable with a pump piston upper surface. During the pressure stroke, the discharge head and the piston rod may be movable downwards by a predetermined length relative to the pump piston. The pump piston may be movable within the pump cylinder with the discharge head and the piston rod upon engagement of the upper and lower surfaces. During the return stroke, the discharge head and the piston rod may be movable upwards by a predetermined length relative to the pump piston. The pump piston may be movable within the pump cylinder with the discharge head and the piston rod by means of a plug which connects the pump piston to the piston rod. In a particular embodiment, the valve assembly may include four symmetrically disposed guide ribs. The guide ribs may include an upper tapered surface for preventing lodgment of the check valve. The aforementioned primary passage may be defined by an area between an outer surface of the check valve, inner surfaces of adjacent guide ribs, and a circumferential boundary defined by an innermost surface of the pump cylinder adjacent the ribs. The aforementioned secondary passage may be defined by an area between a circumferential boundary defined by an innermost surface of the pump cylinder adjacent the ribs, and an inner surface of a longitudinally extending concave channel. The secondary passage may include an inlet flow path having a taper angle greater than a taper angle of the valve seat for facilitating accumulation of the beads in the secondary passage. Further, in a particular embodiment illustrated, the check valve may be a ball check valve.

The invention also provides a valve assembly for a pump or a squeeze dispenser used with a liquid product including a plurality of rupturable beads containing additives capable of being released when the beads are rubbed between the hands of a user. The valve assembly may be provided in a body of the dispenser to respectively allow and prevent the liquid product from being discharged through a discharge orifice during first and second pressure conditions in the body. The valve assembly may include one or more longitudinally extending guide ribs disposed within the body for guiding axial and radial movements of a check valve. The check valve may be disposable in valve open and closed positions in which the check valve is respectively disposed out of and in contact with a valve seat. The valve assembly may include a longitudinally extending primary fluid passage disposed adjacent the guide rib for permitting passage of the liquid containing the beads from a container into the body. The valve assembly may further include a longitudinally extending secondary fluid passage disposed adjacent the primary fluid passage for permitting displacement of the beads during translation of the check valve between the valve open to the valve closed positions for thereby preventing accumulation of the beads between the check valve and the valve seat.

For the valve assembly described above, if the dispenser is a pump dispenser, the dispenser may include a spring biased dispenser head reciprocable between pressure and return strokes to therewith reciprocate a pump piston in the body. The pressure and return strokes may respectively correspond to the first and second pressure conditions. The dispenser may further include a piston rod coupled to the dispenser head and including the pump piston disposed adjacent one end thereof. The piston rod may be axially movable relative to the pump piston and include a lower surface engageable with a pump piston upper surface. During the pressure stroke, the discharge head and the piston rod may be movable downwards by a predetermined length relative to the pump piston, and the pump piston may be movable within the body with the discharge head and the piston rod upon engagement of the upper and lower surfaces. Yet further, the dispenser may further include a piston rod coupled to the dispenser head and including the pump piston disposed adjacent one end thereof. During the return stroke, the discharge head and the piston rod may be movable upwards by a predetermined length relative to the pump piston, and the pump piston may be movable within the body with the discharge head and the piston rod by means of a plug which connects the pump piston to the piston rod.

For the valve assembly described above, regardless of whether the dispenser is a pump or squeeze dispenser, in a particular embodiment, the valve assembly may include four symmetrically disposed guide ribs. The guide ribs may include an upper tapered surface for preventing lodgment of the check valve. The aforementioned primary passage may be defined by an area between an outer surface of the check valve, inner surfaces of adjacent guide ribs, and a circumferential boundary defined by an innermost surface of the body adjacent the ribs. The aforementioned secondary passage may be defined by an area between a circumferential boundary defined by an innermost surface of the body adjacent the ribs, and an inner surface of a longitudinally extending concave channel. The secondary passage may include an inlet flow path having a taper angle greater than a taper angle of the valve seat for facilitating accumulation of the beads in the secondary passage. Further, in a particular embodiment illustrated, the check valve may be a ball check valve.

The invention yet further provides a pump dispenser for use with a liquid product including a plurality of rupturable beads containing additives capable of being released when the beads are rubbed between the hands of a user. The pump dispenser may include a spring biased discharge head reciprocable between pressure and return strokes. A piston rod may be coupled to the discharge head and include a pump piston disposed adjacent one end thereof. The piston rod may be reciprocable with the discharge head to reciprocate the pump piston between the pressure and return strokes within a pump cylinder. A valve assembly may be provided in the pump cylinder to respectively allow and prevent the liquid product from being discharged through a discharge orifice in the discharge head during the pressure and return strokes. The valve assembly may include one or more longitudinally extending guide ribs for guiding axial and radial movement of a check valve. The check valve may be disposable in valve open and valve closed positions in which the check valve is respectively disposed out of and in contact with a valve seat. The valve assembly may include a longitudinally extending enlarged fluid passage for permitting displacement of the beads during translation of the check valve between the valve open to the valve closed positions for thereby preventing accumulation of the beads between the check valve and the valve seat.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 2 is a cross-sectional view taken substantially along section 2-2 in FIG. 1, illustrating the improved inlet valve assembly and the radial layout of the cavities for permitting temporary displacement of beads during the piston pressure stroke;

FIG. 3 is an enlarged cross-sectional view of the pump dispenser of FIG. 1, taken substantially along section 3-3 in FIG. 2, illustrating the improved inlet valve assembly and the ball check valve disposed in a valve closed configuration against its valve seat;

FIG. 4 is an enlarged cross-sectional view of the pump dispenser of FIG. 1, taken substantially along section 4-4 in FIG. 2, illustrating the improved inlet valve assembly and the ball check valve disposed in a valve closed configuration against its valve seat; and FIG. 5 is an enlarged cross-sectional view of a related-art valve assembly, illustrating the manner in which beads prevent the ball check valve from properly seating against its valve seat.

DETAILED DESCRIPTION OF THE PREFERRED EMBODIMENTS

Figure 1:
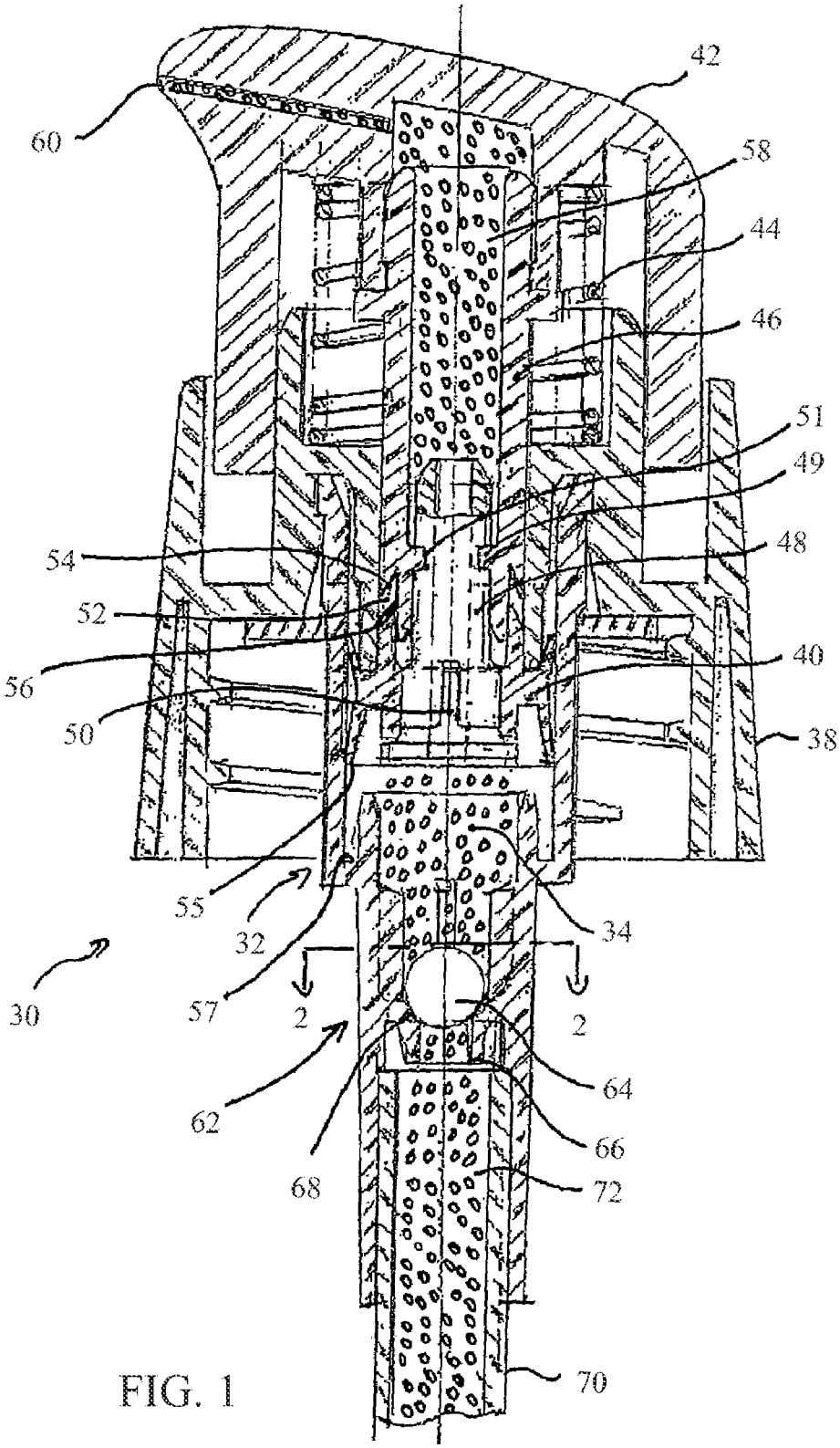
FIG. 1 is a partial cut-out view of a pump dispenser according to the present invention, including an improved inlet valve assembly having a ball check valve disposed in a valve closed configuration against its valve seat.

Turning now to the drawings wherein like reference characters refer to like and corresponding parts throughout the several views, a manually actuated pump dispenser is generally designated 30 in FIG. 1, the dispenser being of the type disclosed in co-pending U.S. application Ser. No. 11/327,433 ('433 application), titled "Dispenser Having Air Tight Spout," owned by the assignee of the present invention, and U.S. Pat. No. 5,447,258 ('258 Patent), the respective disclosures of which are specifically incorporated herein by reference. The invention is likewise adaptable for use with other known pump dispensers and squeeze dispensers without departing from the scope of the invention.

Referring to FIGS. 1-4 of the present invention, pump dispenser 30 may generally include a pump housing 32 which defines a pump cylinder 34 having a pump piston 40 reciprocally disposed therein. The housing, which is open at its upper end, may be supported by a conventional container closure 38 in the form of an internally threaded cap, which is adapted to support the pump housing within the interior of a container (not shown) to dispense the liquid product from the container as desired. As evident to those skilled in the art, instead of the threaded container closure illustrated in FIG. 1, closure 38 may be a snap-fit or another type of closure for attaching dispenser 30 onto a container. A spring biased discharge head 42 may be supported at the upper end of pump piston 40. Head 42 may be biased to the extended (rest) position of FIG. 1 under the bias of spring 44.

Discharge head 42 may be fixedly mounted to hollow piston rod 46, which may be further fixedly mounted to plug 48 by means of detent 49 disposed in groove 51 of plug 48. Plug 48 may include longitudinally extending ribs 50. During the pressure stroke when discharge head 42 is pressed downwards, the longitudinal channels between adjacently disposed ribs 50 may permit passage of liquid product from pump cylinder 34 to discharge passage 58 and out through discharge orifice 60 of discharge head 42. Piston rod 46 may be slidably disposed relative to pump piston 40, which may be hollow and include plug 48 disposed therein as illustrated. Piston rod 46 may further include a gap 52 between respective surface 54 thereof and surface 56 of pump piston 40. In this manner, piston rod 46 may slide by a predetermined length relative to pump piston 40 during reciprocation of discharge head 42.

Specifically, during the piston pressure stroke when discharge head 42 is first pressed downwards, piston rod 46 may slide downwards until surfaces 54 and 56 engage. Further downwards movement of discharge head 42 moves pump piston 40 downwards until the bottom surface 55 of piston 40 engages surface 57 of pump cylinder 34, while the contents of cylinder 34 are discharged through discharge orifice 60 as discussed above. On the ensuing return stroke, discharge head 42 and piston rod 46 move upwards under the bias of spring 44. Initially, due to the frictional engagement between pump piston 40 and the inner wall 59 of pump cylinder 34, surface 55 of pump piston 40 remains in contact with surface 57 of pump cylinder 34. This frictional engagement allows surfaces 54 and 56 to re-separate and create gap 52. Further upward movement of discharge head 42 carries pump piston 40 upwards to re-fill cylinder 34 with liquid product by virtue of the negative pressure created in pump cylinder 34 and the operation of valve assembly 62 as described below.

Pump cylinder 34 may generally include a valve assembly 62 having a one-way ball check valve 64 disposed therein for allowing liquid product from the container to enter into cylinder 34 via inlet port 66 during the piston return stroke, which occurs upon the release of discharge head 42 after its pressure stroke. As illustrated in FIG. 1, during the pressure stroke, ball check valve 64 may be disposed in contact with valve seat 68 to effectively seal pump cylinder 34 and prevent liquid product disposed in cylinder 34 from returning to the container via dip tube 70.

As discussed above in the Description of the Related Art, while the pump dispenser of FIG. 5 operates adequately with typical paste and gel products having a uniform consistency, for a new type of personal care product 72 (i.e. product 26 of FIG. 5) which includes "beads" 74 (i.e. beads 24 of FIG. 5) containing fragrances, medicine, skin nutrients and other additives, the pump dispenser of FIG. 5 has several drawbacks, among those noted hereinabove.

Optimally, when dispensing a personal care product containing beads 74, the dispenser should have the capability to discharge a metered dose of the product contained within pump cylinder 34 to thus allow a user to conveniently rub the product between his/her hands and frictionally rupture the beads to release the additives therein. As discussed above, the discharging of a metered dose of product is essential, because the beads, which are of a predetermined size and contain a measured quantity of fragrances, medicine, skin nutrients or other additives, are intended to be discharged with a predetermined amount of liquid product to produce a desired end result. Since the pump dispenser of FIG. 5 includes drawbacks such as accumulation of beads below the ball check valve during the pressure strokes, which results in an unwanted return of product from the pump cylinder to the container and an increase or decrease in the liquid product-to-bead ratio in the discharged dosage, the pump dispenser of FIGS. 1-4 includes an improved pump housing and valve assembly for overcoming the aforenoted drawbacks.

Specifically, referring to FIGS. 2-4, pump housing 32 may include valve assembly 62 having a plurality of longitudinally extending ribs 76 for guiding axial and radial movement of ball check valve 64 between valve open and closed configurations respectively corresponding to the aforementioned discharge head return and pressure strokes. Ribs 76 may be disposed in the symmetrical relationship illustrated in FIG. 2, and include an upper tapered surface 78 for preventing inadvertent lodgment of ball check valve 64 on the ribs. While the conventional pump housing of FIG. 5 includes passages 80 between ribs 20, assembly 62 of FIGS. 1-4 may include axially extending primary passages 82 (similar to passages 80 of FIG. 5) and further include secondary passages 84 formed as cavities (see FIG. 2) for permitting displacement of beads 74 during the piston pressure stroke. It should be noted that while in the exemplary embodiment of FIG. 2, primary passages 82 are defined as the area between ball check valve 64, adjacent inner surfaces of ribs 76 and the circumferential boundary of surfaces 83, in the event surfaces 83 were to be eliminated, primary passages 82 could alternatively be defined as the area between valve 64, adjacent inner surfaces of ribs 76 and the circumferential boundary defined by edges 85.

In order to facilitate the displacement of beads 74 into the area of secondary passages 84, passages 84 may include inlet flow paths 86 at the bottom-most ends thereof. As illustrated in FIG. 4, flow paths 86 may include an angel of taper greater than the taper angle of valve seat 68. In this manner, during the piston pressure stroke while check valve is moving from its valve open to its valve closed position, any beads 74 which have a tendency to accumulate below valve 64 divide into two sets, one following the flow path defined by tapered valve seat 68 and the other following tapered flow path 86 into the area of secondary passages 84. During the ensuing piston pressure stroke, beads 74 freely displace within liquid product 72 and are discharged through discharge orifice 60, as discussed above.

Compared to the pump dispenser of FIG. 5, the dispenser of FIGS. 1-4 of the present invention provides several distinct benefits. For example, during the piston pressure and return strokes, the relatively supple beads 74 suspended in liquid product 72 divide into two sets, one following the flow path defined by tapered valve seat 68 and the other following tapered flow path 86 into the area of secondary passages 84, and therefore allow valve 64 to properly seat against valve seat 68 and seal the pump cylinder. The proper seating of check valve 64 prevents any liquid product 72 from returning from pump cylinder 34 to the container, and thus eliminates contamination of unused product disposed in the container. Further, the proper seating and sealing of the pump cylinder ensures discharge of a metered dose of liquid product via discharge orifice 60. These operational benefits ensure that the discharged product includes the required amount of liquid product-to-bead ratio for providing the intended dosage of fragrances, medicine, skin nutrients or other additives.

As discussed above, various modifications may be made to the pump dispenser and valve assembly without departing from the scope of the present invention. For example, although four ribs 76 and primary passages 82 are disclosed, the number of passages may be increased or decreased depending on the size of beads 74, as would be apparent to those skilled in the art. Likewise, the size of secondary passages 84 may be increased or decreased as needed depending on the size of beads 74. Referring to FIG. 4, the taper angle of flow paths 86 may also be varied relative to the taper of valve seat 68 for facilitating movement of beads 74 into secondary passages 84.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A pump dispenser, comprising:

a pump housing;

a pump cylinder defined in the pump housing, comprising:

a valve seat having a valve seat taper angle;

a circumferential boundary of surfaces;

a plurality of longitudinally extending ribs positioned between the valve seat and the circumferential boundary of surfaces;

a ball check valve positioned at a lower end of the pump cylinder;

at least one secondary passage outside the circumferential boundary of surfaces; and a tapered flow path between the valve seat and the at least one secondary passage, the tapered flow path comprising an angle of taper greater than the valve seat taper angle.

2. The pump dispenser of claim 1, further comprising at least one primary passage, wherein the at least one primary passage comprises the area between the ball check valve adjacent an inner surface of one of the plurality of longitudinally extending ribs and the circumferential boundary of surfaces.

3. The pump dispenser of claim 1, wherein the plurality of longitudinally extending ribs comprises at least two longitudinally extending ribs.

4. The pump dispenser of claim 1, wherein the plurality of longitudinally extending ribs comprises at least four longitudinally extending ribs disposed in a symmetrical relationship.

5. The pump dispenser of claim 1, wherein the plurality of longitudinally extending ribs further comprises a plurality of longitudinally extending ribs having an upper tapered surface.

6. The pump dispenser of claim 1, wherein the at least one secondary passage outside the circumferential boundary of surfaces comprises at least one cavity in a wall of the pump cylinder.

7. The pump dispenser of claim 1, wherein the tapered flow path between the valve seat and the at least one secondary passage comprises a tapered flow path with a terminating point at the valve seat and wherein the ball check valve is seated against the terminating point during a pressure stroke of the pump dispenser.

8. The pump dispenser of claim 1, further comprising:

a pump piston reciprocally disposed in the pump housing;

a piston rod slidably disposed relative to the pump piston;

a discharge head mounted at an upper end of the piston rod; and a spring biasing the discharge head.

9. A pump dispenser comprising:

a pump cylinder;

a valve assembly positioned at a lower end of the pump cylinder, the valve assembly comprising:

a check valve movable between valve open and valve closed positions;

a valve seat having a first taper angle;

a longitudinally extending primary fluid passage bounded by a circumferential boundary around an outer circumference; and at least one secondary fluid passage formed as a longitudinally extending cavity in the circumferential boundary, wherein the longitudinally extending cavity comprises a cavity in a wall of the pump cylinder.

10. The pump dispenser of claim 9, further comprising an inlet flow path at the bottom-most end of the secondary fluid passage and extending between the secondary fluid passage and the valve seat, wherein the inlet flow path comprises a second taper angle greater than the first taper angle.

11. The pump dispenser of claim 9, further comprising a plurality of longitudinally extending guide ribs.

12. The pump dispenser of claim 11, wherein the number of the cavities equals the number of guide ribs.

13. The pump dispenser of claim 9, wherein the plurality of longitudinally extending guide ribs are spaced symmetrically within the valve assembly.

14. The pump dispenser of claim 9, further comprising:

a discharge head reciprocable between pressure and return strokes, a piston rod coupled to the discharge head;

a pump piston disposed adjacent one end of the piston rod, the pump piston reciprocating between the pressure and return strokes within the pump cylinder.

15. A pump dispenser for use with a liquid product, the pump dispenser comprising:

a pump cylinder;

a valve assembly comprising:

a valve seat having a first taper angle;

a check valve disposable in valve open and valve closed positions in which the check valve is respectively disposed out of and in contact with the valve seat, a plurality of longitudinally extending guide ribs for guiding axial and radial movements of the check valve, a fluid passage formed as a cavity disposed adjacent the valve seat, the cavity having at its lower end an inlet flow path comprising a second taper angle greater than the first taper angle, wherein the cavity comprises a longitudinally extending cavity in a wall of the pump cylinder.

16. The pump dispenser of claim 15, wherein the plurality of longitudinally extending guide ribs comprises at least three guide ribs symmetrically spaced within the valve assembly.

17. The pump dispenser of claim 15, comprising a plurality of the cavities equal in number to the number of guide ribs.

18. The pump dispenser of claim 15, further comprising:

a spring biased discharge head reciprocable between pressure and return strokes, a piston rod coupled to the discharge head and including a pump piston disposed adjacent one end thereof, the piston rod being reciprocable with the discharge head to reciprocate the pump piston between the pressure and return strokes within the pump cylinder.

* * * * *